US005481287A

United States Patent [19]

Tachihara

[11] Patent Number: 5,481,287

[45] Date of Patent: Jan. 2, 1996

[54] LIQUID JET RECORDING HEAD HAVING A PLURALITY OF HEATING ELEMENTS AND LIQUID JET RECORDING APPARATUS HAVING THE SAME

[75] Inventor: Masayoshi Tachihara, Atusgi, Japan

[73] Assignee: Canon Kabushiki Kaisha, Tokyo, Japan

[21] Appl. No.: 355,812

[22] Filed: Dec. 14, 1994

Related U.S. Application Data

[63] Continuation of Ser. No. 45,310, Apr. 12, 1993, abandoned, which is a continuation of Ser. No. 742,549, Aug. 8, 1991, abandoned, which is a continuation of Ser. No. 434,576, Nov. 13, 1989, abandoned, which is a continuation of Ser. No. 137,337, Dec. 23, 1987, abandoned.

[30] Foreign Application Priority Data

Dec. 25, 1986 [JP] Japan ..... 61-307931

[51] Int. Cl.[6] ..... B41J 2/05

[52] U.S. Cl. ..... 347/62; 347/64; 347/206; 347/15

[58] Field of Search ..... 347/62, 15, 58, 347/206, 64, 57

[56] References Cited

U.S. PATENT DOCUMENTS

| | | | |
|---|---|---|---|
| 4,251,824 | 2/1981 | Hara | 347/57 |
| 4,339,762 | 7/1982 | Shirato | 347/64 |
| 4,345,262 | 8/1982 | Shirato | 347/57 |
| 4,458,256 | 7/1984 | Shirato | 347/58 X |
| 4,492,966 | 1/1985 | Seki et al. . | |
| 4,514,741 | 4/1985 | Meyer | 347/62 |
| 4,590,489 | 5/1986 | Tsumura | 347/206 |
| 4,602,261 | 7/1986 | Matsuda | 347/58 |
| 4,623,901 | 11/1986 | Nagashima | 347/206 |
| 4,646,110 | 2/1987 | Ikeda et al. . | |
| 4,723,129 | 2/1988 | Endo | 347/56 |
| 4,940,999 | 7/1990 | Ikeda | 347/58 |

*Primary Examiner*—Joseph W. Hartary
*Attorney, Agent, or Firm*—Fitzpatrick, Cella, Harper & Scinto

[57] ABSTRACT

A liquid jet recording head includes a liquid path communicating with a discharge opening through which a liquid is discharged; a plurality of heating elements disposed in the liquid path, each of the heating elements having a different minimum power requirement for enabling the liquid to be discharged; and electrodes for allowing electric power to be simultaneously supplied to the plurality of heating elements. This invention further provides a liquid jet recording apparatus having a liquid jet recording head constructed in the above-described manner. The power density of each heating element is varied by the application of a drive voltage, thereby enabling stable step control over the gradation of an image recorded without the need for complicated wiring.

14 Claims, 9 Drawing Sheets

LIQUID JET RECORDING HEAD HAVING A PLURALITY OF HEATING ELEMENTS AND LIQUID JET RECORDING APPARATUS HAVING THE SAME

This application is a continuation of application Ser. No. 08/045,310 filed Apr. 12, 1993, now abandoned, which was a continuation of application Ser. No. 07/742,549 filed Aug. 8, 1991, now abandoned, which was a continuation of application Ser. No. 07/434,576 filed Nov. 13, 1989, now abandoned, which was a continuation of application Ser. No. 07/137,337 filed Dec. 23, 1987, now abandoned.

BACKGROUND OF THE INVENTION

1. Field of the Invention

The present invention relates generally to a liquid jet recording head for performing recording by discharging a liquid (ink) in a jet and causing droplets to fly toward a recording medium, as well as a liquid jet recording apparatus having such a liquid jet recording head. More specifically, the invention relates to a liquid jet recording head which enables gradation recording as well as a liquid jet recording apparatus having the same.

2. Related Background Art

It is well known that use of liquid discharge openings which are integrated at high density is effective in faithfully recording an original image by means of such a liquid jet recording head. In addition, gradation recording is needed in order to faithfully reproduce the gradient of an original image within a limited range of recording density.

Various proposals have been made with respect to liquid jet recording heads, in particular, liquid jet recording heads of the type that employs an electricity-heat conversion member as energy generating means for generating energy used to discharge a liquid to thereby perform gradation recording. U.S. Pat. No. 4,339,762 discloses a structure in which a temperature gradient occurs in a heating portion. U.S. Pat. No. 4,251,824 and Japanese Patent Laid-open No. 132259/1980 disclose an arrangement in which each liquid path includes at least two heating elements which allow at least two independent signals to be input.

FIG. 1A is a diagrammatic perspective view illustrating a conventional type of liquid jet recording head comprised of a plurality of liquid discharge portions which are disposed in an integrated form, each of the liquid discharge portions including a liquid path, a heating portion, and a liquid discharge opening. FIG. 1B is a diagrammatic cross section taken along the line X—X' of FIG. 1A. FIG. 2 is a diagrammatic view illustrating on an enlarged scale the heating portion of a liquid jet recording head which relies upon the related art disclosed in the aforementioned U.S. Pat. No. 4,339,762.

In FIGS. 1, 2 and 3, heating elements 107 (107-1 to 107-6), a common electrode 106, and selectively operable electrodes 105 are disposed over a substrate 103, the electrodes 106 and 105 being provided for energization. The substrate 103 and a grooved cover plate 102 are bonded by adhesive layers 104 (104-1 to 104-7) so that each of the heating elements 107 corresponds to each groove 101 (101-1 to 101-6) which is defined between adjacent ones of separation walls 101*a* to 101*g* formed on one side of the grooved cover plate 102. A liquid or ink is introduced into the liquid jet recording head having the above-described arrangement and, when the heating elements 107 are heated, the ink charged into the liquid paths is subjected to rapid pressure changes for causing the ink to bubble. In consequence, the ink is discharged in a jet through the liquid discharge openings which are defined by the grooved cover plate 102 and the substrate 103.

In this related art example, as shown in FIG. 2, the heating elements 107 are constituted by heating resistive elements 108 which are flat in cross section and trapezoidal in plan view. As illustrated, a narrow portion A connected to the common electrode 106 exhibits a high resistance per unit length and a wide portion B connected to the electrode 105 exhibits a low resistance per unit length. Accordingly, the level of the voltage across the heating resistive element 108 which voltage is required to cause generation of a bubble at a portion A is lower than the level of the voltage across the heating resistive element 108 which voltage is required to cause a bubble to be generated at the whole of the resistive element 108. Therefore, the size (or diameter) of a bubble can be controlled through adjustment of the level of drive voltage applied to the heating resistive element 108, thereby enabling gradation recording.

However, in a case where the drive voltage is adjusted so as to cause droplets having the same diameter to be discharged through the liquid discharge openings of such a liquid jet recording head, such droplets having the same diameter may be observed immediately after the ink has been discharged. However, after the ink droplets have been stuck to a recording surface, when the size (or diameter) of each ink dot is measured, there is a case where each dot has a different size.

It has heretofore been considered that the reason for this phenomenon is that, when a bubble is generated at a portion of the heating resistive element 108 (for example, a portion thereof equivalent to ⅓, ½ or ⅔ of its whole area which extends from the portion A), a multiplicity of minute bubbles are generated in the vicinity of the boundary between an area in which the bubble is generated and an area in which no bubble is generated, and the minute bubbles cause variations in the speed of droplet discharge, that is, the speed of droplets at the moment they strike the recording surface. Accordingly, the above-described liquid jet recording head has had several problems to be solved in order to achieve stable gradation recording.

FIG. 3 is a diagrammatic view illustrating on an enlarged scale one of the heating portions of a liquid jet recording head which relies upon the related art, such is that disclosed in the aforementioned U.S. Pat. No. 4,251,824 and Japanese Patent Laid-open No. 132259/1980. The illustrated heating portion includes heating elements 301-1 and 301-2, a common electrode 302, and selectively operable electrodes 303-1 and 303-2 which are connected to the heating elements 301-1 and 301-2, respectively. By using this related art heating portion, it is possible to provide step control over the area required for bubble generation by controlling the number of heating resistive elements to be driven, by making the levels of discharge energy of the heating elements 301-1 and 301-2 different from each other to selectively drive one of them, or by providing the phase difference between signals to be independently input to the heating elements 301-1 and 301-2.

In the above-described liquid jet recording head, in order to increase the number of steps of gradation per liquid path, it is necessary to increase the number of heating elements and the number of wires in each liquid path. In this case, however, it becomes difficult to integrate the arrangement of each liquid discharge portion at high density because of limitations imposed by the thicknesses of the wires. This difficulty may hinder faithful reproduction of an original image to a remarkable extent. To the end of avoiding this difficulty, it may be considered that the high-density integration of the liquid discharge portions can be achieved by utilizing multi-layer wiring or the like. However, this proposal involves a complicated process and may cause an increase in the cost of production. In addition, it is necessary for each liquid path to provide drive circuits for inputting at least two independent signals. In some instances, this necessity complicates the structures of liquid jet record heads of the type having a plurality of discharge openings.

SUMMARY OF THE INVENTION

It is therefore an object of the present invention to provide a liquid jet recording head and a liquid jet recording apparatus having the same, in which liquid jet recording head a high-density arrangement of each liquid discharge portion can be achieved by using remarkably simplified wiring and in which a liquid (or ink) is discharged at a uniform speed from each liquid discharge portion so that gradation control which enables high-density recording can be performed.

It is another object of the present invention to provide a liquid jet recording head comprising a liquid path communicating with a discharge opening through which a liquid is discharged; a plurality of heating elements disposed in the liquid path, each of the heating elements having a different minimum power requirement for enabling the liquid to be discharged; and electrodes for allowing electric power to be simultaneously supplied to the plurality of heating elements.

It is another object of the present invention to provide a liquid jet recording apparatus having a liquid jet recording head which is constructed in the above-described manner.

For achieving the above and other objects, the present invention provides a liquid jet recording head wherein a plurality of heating elements are disposed within a liquid path, each heating element having a different aspect ratio which allows for a different minimum power requirement which enables formation of bubbles. Each connection member which has a sufficiently lower resistance than those of the heating elements is disposed between adjacent ones thereof, and the connection members and the heating elements are alternately connected in series. The power density of each heating element is varied by the application of a drive voltage, thereby enabling stable step control over the gradation of an image to be recorded without the need for complicated wiring. The present invention further provides a liquid jet recording apparatus having the hereinabove described liquid jet recording head.

The above and other objects, features and advantages of the present invention will become apparent from the following description of the preferred embodiments thereof, taken in conjunction with the accompanying drawings.

DESCRIPTION OF THE PREFERRED EMBODIMENTS

Figure 1A:
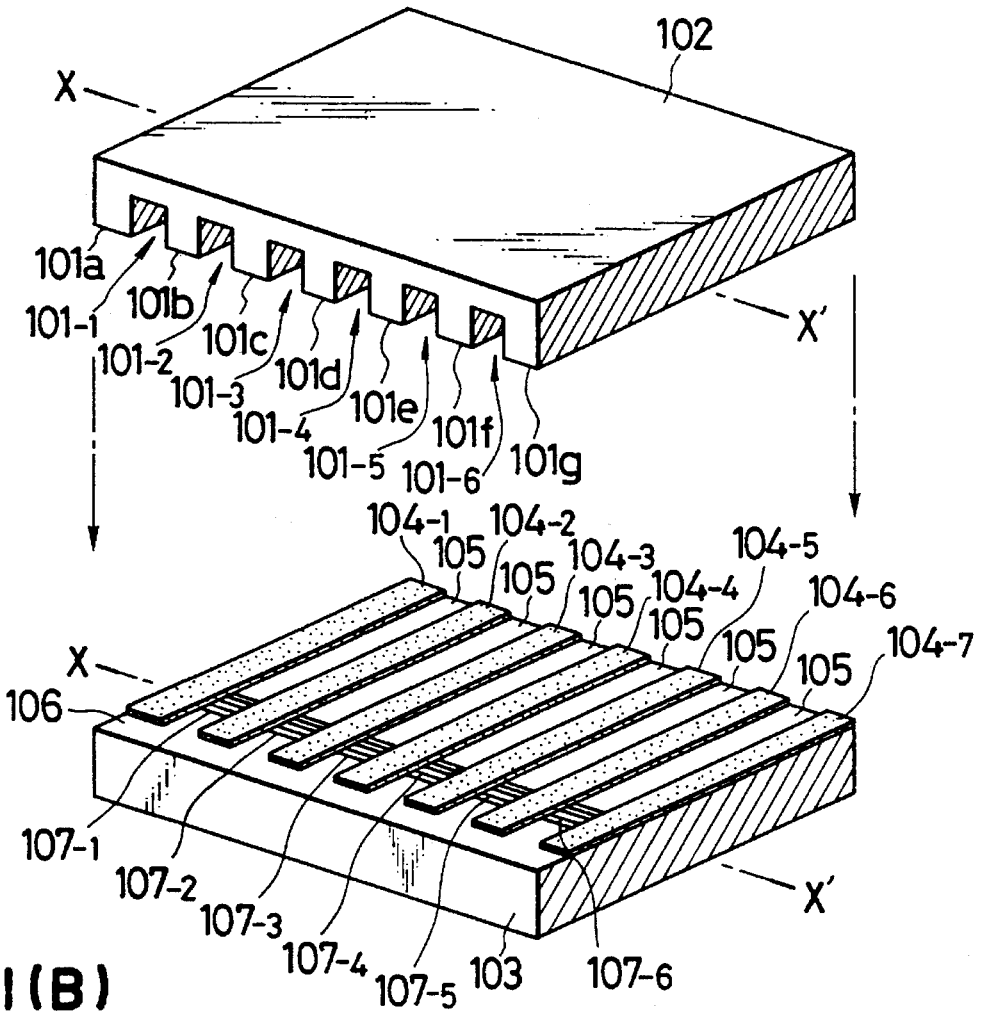
FIG. 1(A) PRIOR ART
FIG. 1A is a diagrammatic perspective view illustrating in disassembled form one example of a liquid jet recording head of the related art.
Figure 1B:
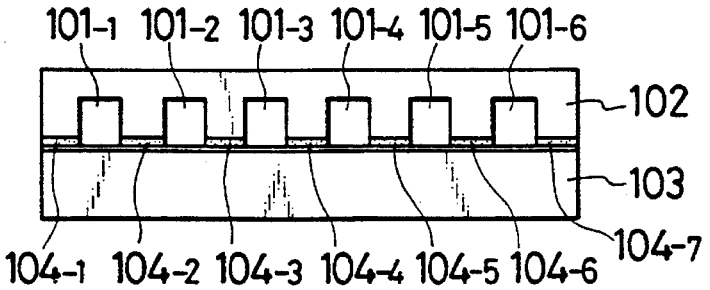
FIG. 1(B) PRIOR ART
FIG. 1B is a diagrammatic cross section taken along the line X—X' of FIG. 1A.
Figure 2:
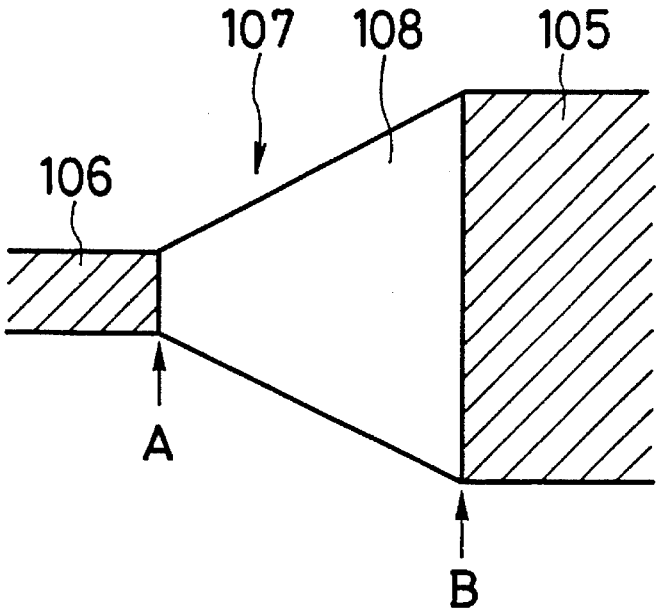
FIG.2 PRIOR ART
FIG. 2 is a schematic plan view of one example of the heating portion of the liquid jet recording head of the related art.
Figure 3:
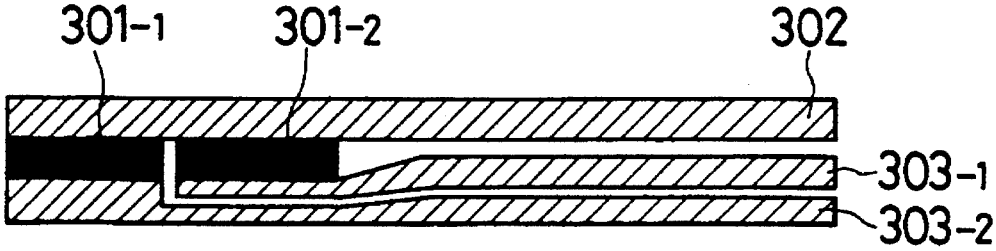
FIG.3 PRIOR ART
FIG. 3 is a diagrammatic plan view of another example of the heating portion of the liquid jet recording head of the related art.
Figure 4A:
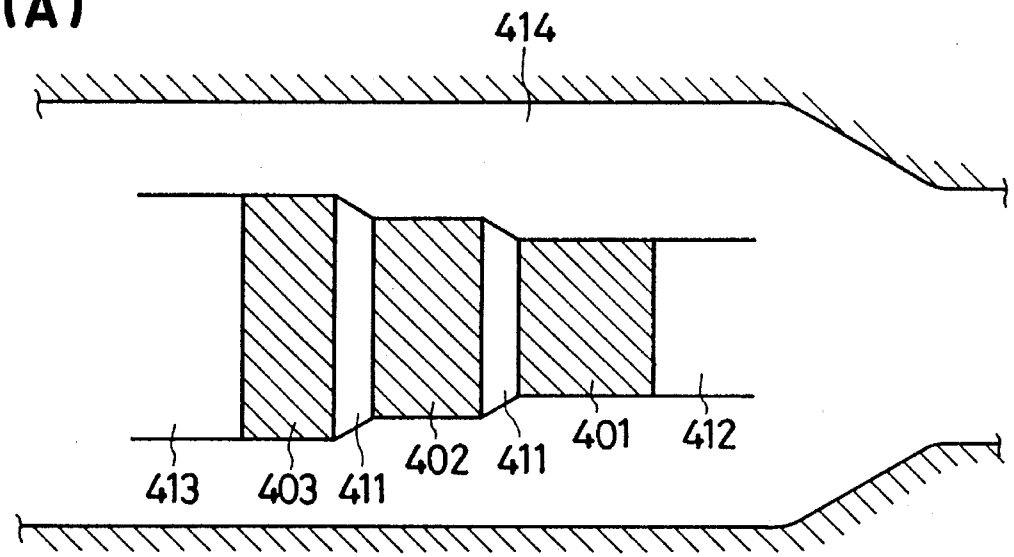
FIG. 4A is a diagrammatic illustration of the general construction of the heating portion of a liquid jet recording head in accordance with the present invention.
Figure 4B:
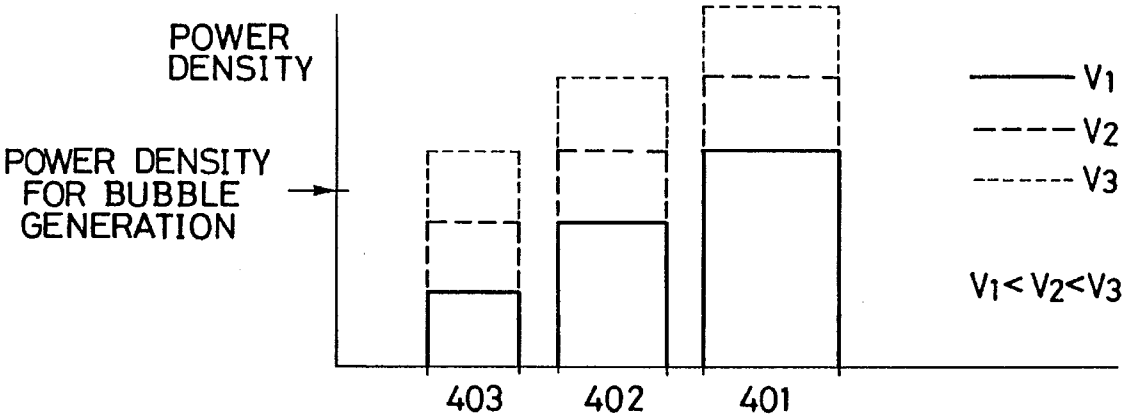
FIG. 4B is a graph showing the operation of the FIG. 4A heating portion in accordance with the present invention.

In the present invention which will be described in detail later in conjunction with preferred embodiments thereof, as shown in FIG. 4A, a plurality of heating elements, for example, three heating elements 401, 402 and 403 are disposed within each of liquid paths 414, and each of the heating elements has, as illustratively shown, a different aspect ratio which allows for a different minimum power requirement for formation of bubbles. Each connection member 411 has a sufficiently lower resistance than those of the heating elements, and is disposed between adjacent ones of them. The connection members 411 and the heating elements, for example, are alternately connected in series. In this arrangement, as illustratively shown in FIG. 4B, a voltage $V_1$ of such a level as to cause generation of a bubble in an area above the heating element 401 alone is first applied between a pair of electrodes 412 and 413 through which electric power is supplied, and the respective power densities of the heating elements 401, 402 and 403 assume levels such as those shown by solid lines in FIG. 4B. At this point in time, the power densities in the heating elements 402 and 403 are lower than that required for generation of bubbles. Accordingly, no unstable minute bubble is generated which may be observed in a case where bubbles are narrowly generated. This is because the value of resistance is continuously varied. Then, when a voltage $V_2$ of such a level as to cause generation of a bubble in an area above the heating elements 401 and 402 is applied, a larger droplet than that generated by the application of the voltage $V_1$ is discharged. Furthermore, when the level of applied voltage is risen to the level of $V_3$, bubble generation is caused at all of the heating elements 401 to 403, thereby enabling a further large droplet to be discharged. The above description illustratively refers to the effect produced by the serial arrangement of the heating elements and the associated parts. However, similar effects can be achieved by the parallel arrangement of them. Accordingly, it will be appreciated that the present invention enables stable step control over the gradation of an image to be recorded without the need for complicated wiring.

A material suitable for use in formation of the aforesaid heating elements in the present invention may be selected from the group consisting of tantalum nitride, nickel-chromium, silver-palladium alloy, silicon, semiconductors or metals such as hafnium, lanthanum, zirconium, titanium, tantalum, tungsten, molybdenum, niobium, chromium, vanadium, etc., alloys thereof and bodies thereof as preferable ones.

Also, a material suitable for use in formation of the connection members such as the electrodes for providing electrical connection may be selected from the group consisting of metals such as aluminium, silver, gold, platinum and copper.

Preferred embodiments of the present invention will be described below in more detail with reference to the accompanying drawings.

Figure 5A:
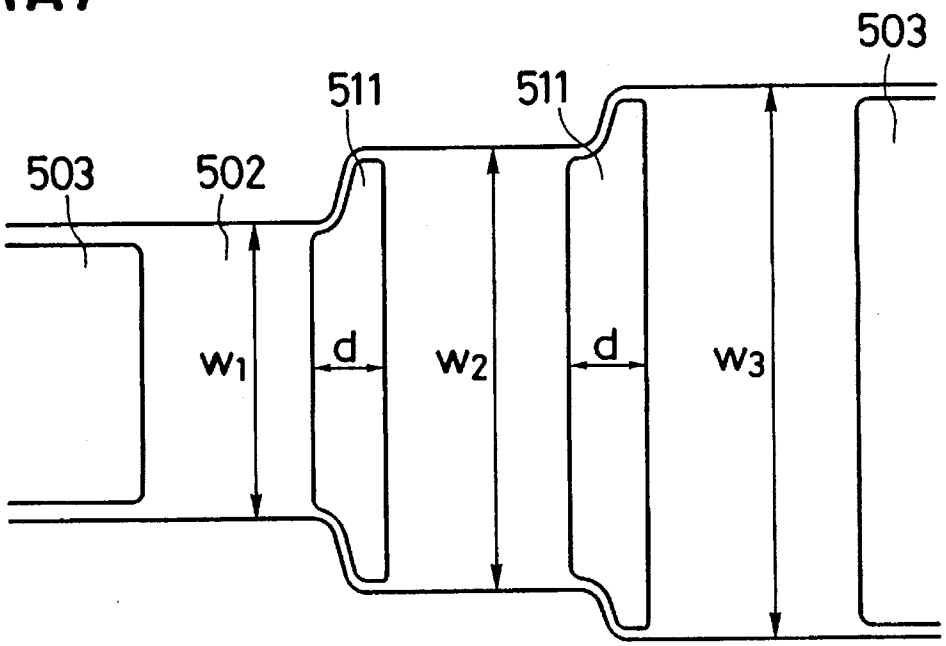
FIG. 5A is a diagrammatic plan view illustrating the essential portion of a first preferred embodiment of the liquid jet recording head of the present invention.

Referring to FIG. 5A which illustrates a first preferred embodiment of the present invention, a substrate 500 in this embodiment is formed of glass, but may also be formed of Si (silicon). A heat accumulating layer 501 which overlies the substrate 500 is formed of, for example, $SiO_2$. A heating resistive-element layer 502 of $HfB_2$ is formed over the heat accumulating layer 501, and a pair of electrodes 503 made of Aluminum are formed on the heating resistive-element layer 502. These layers and electrodes are covered by a protective film 504 of $SiO_2$ or SiN, and the protective film 504 is further coated with an anti-cavitation film 505 of Ta. In this embodiment, a portion having a width $w_1$, a portion having a width $w_2$ and a portion having a width $w_3$ are provided as heating elements, and these elements are electrically connected in series by connecting members 511 each having a length d and electrical conductivity sufficiently higher than that of the heating resistive-element layer 502.

Thus, as is shown from left to right in FIG. 5(A), electrode 503 contacts a resistor 502 having a constant width $w_1$, which in turn is connected to a wider resistor having a constant width $w_2$ via tapered connector 511. The width of tapered connector 511 increases from $w_1$ to $w_2$, and the length of the connector is d. Successive resistors are connected in the same manner by other connectors 511, all of which are of length d, until at last the final resistor is connected to electrode 503.

If it is assumed here that the heating elements are made of the same substance, when $V_{op}$ represents the drive voltage applied to all the heating elements, the power density per unit area in each of the heating elements assumes the following relationship:

$$e_i \propto (V_{op}/w_i)^2 \ (i=1, 2, 3) \qquad (1)$$

In this embodiment, since all the heating elements have the same film construction, it is considered that a bubble is generated when the power density calculated from the equation (1) reaches a predetermined value $e_{th}$. Accordingly, the level of voltage required for bubble generation is proportional to the width of each heating element.

Figure 5B:
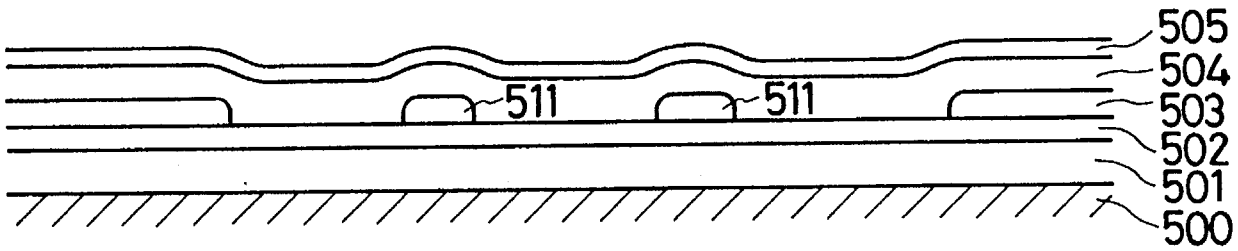
FIG. 5B is a diagrammatic side view in cross section of the first embodiment shown in FIG. 5A.
Figure 6A:
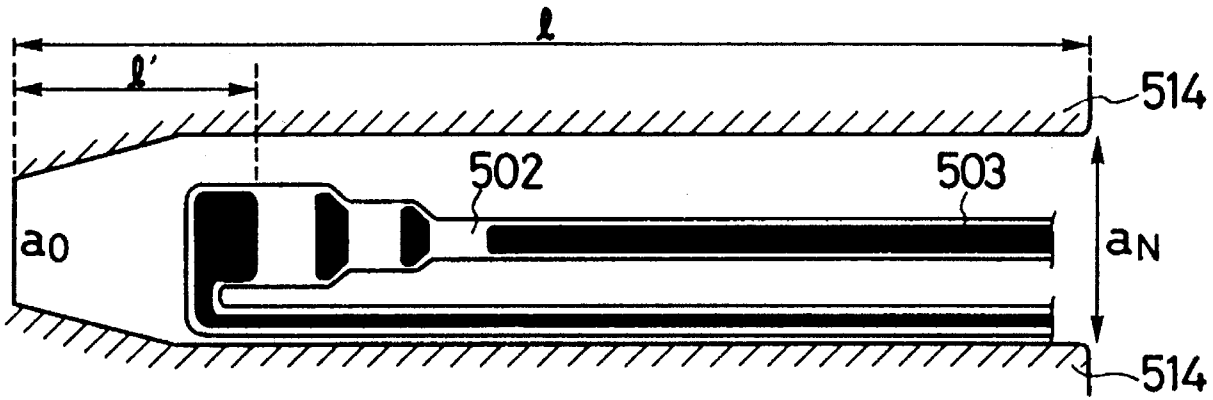
FIG. 6A is a diagrammatic plan view illustrating one example of the liquid discharge portion of a liquid jet recording head having the heating portion shown in FIGS. 5A and 5B.
Figure 6B:
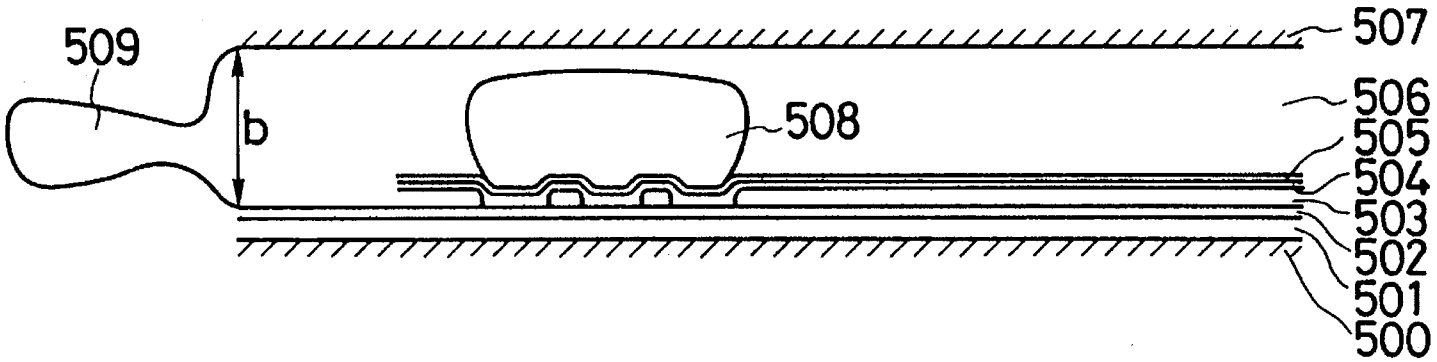
FIG. 6B is a diagrammatic side view in cross section of the example shown in FIG. 6A.

By way of example, in the liquid discharge portion shown in FIGS. 5A and 5B, $w_1$, $w_2$ and $w_3$ were set to 25 μm, 30 μm, and 36 μm, respectively. The level of a drive voltage required for driving each of the heating elements having these widths was calculated, and the heating element was driven at 30 V, 37 V and 43 V. Droplets at the respective three applied voltages were 48 μm, 60 μm, and 72 μm in size (diameter). Extremely high quality dots which exhibited a substantially uniform dot diameter in each step of gradation were formed on a recording surface. In FIGS. 6A and 6B, a liquid before discharge is indicated at 506 and a grooved cover member is indicated at 507. Reference numeral 508 represents a bubble, and a liquid which is being discharged is indicated at 509. Portions 514 serve as separation walls between which a liquid path is defined. In FIGS. 6A and 6B, l was 680 μm, $a_0$ was 40 μm, $a_N$ was 60 μm, b was 42 μm, and l' was 88 μm.

Figure 7:
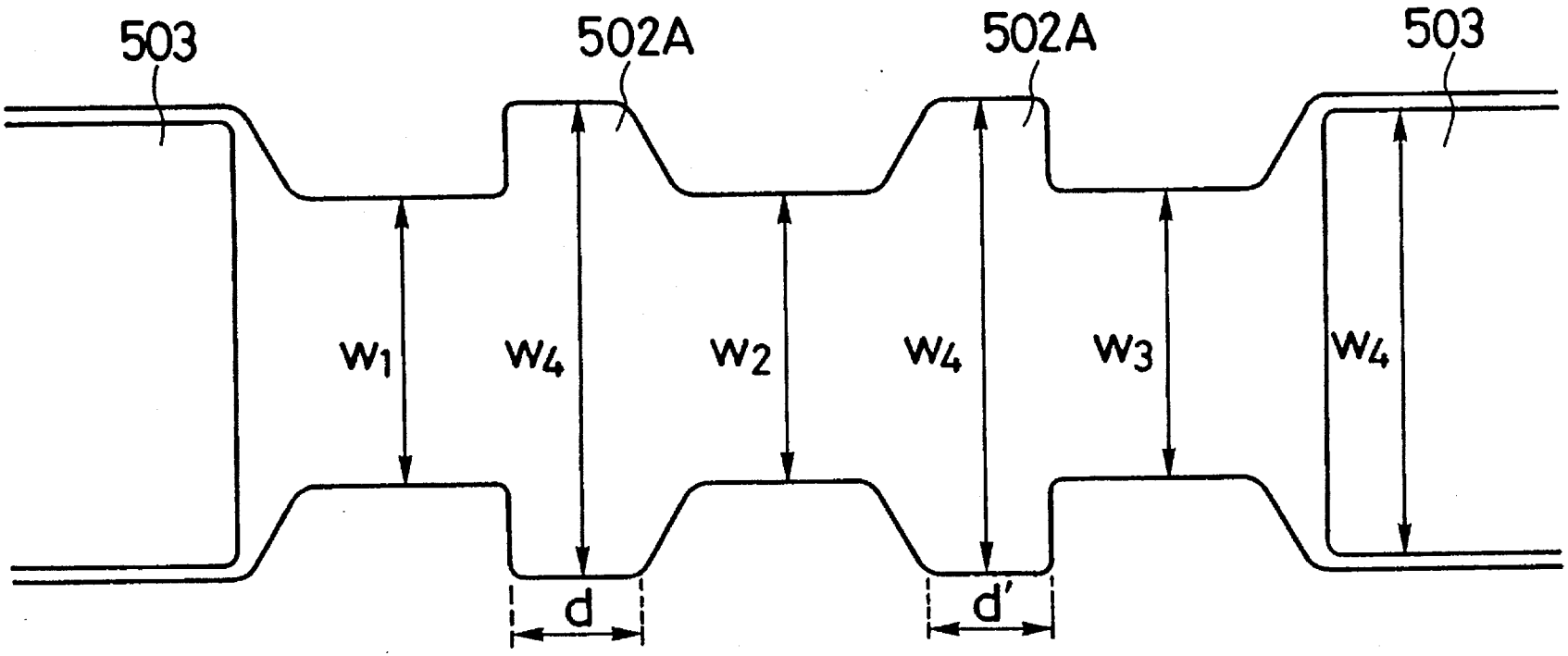
FIG. 7 is a diagrammatic plan view illustrating the essential portion of a second preferred embodiment of the liquid jet recording head of the present invention.

FIG. 7 shows a second preferred embodiment of the present invention. In this embodiment as well, three heating elements are formed, each having a different width, but portions 502A of the heating resistive-element layers 502 are each formed between adjacent ones of the heating elements, and the portions 502A have a sufficiently large width $w_4$ ($w_4$ is much greater than $w_1$, $w_2$, $w_3$). Therefore, in a case where bubbles are generated at all heating elements of the widths $w_1$ to $w_3$, this bubble generation is not affected by the widened portions 502A.

In this embodiment having the above-described construction, by way of example, $w_1$, $w_2$, $w_3$, $w_4$, and d were set to 25 μm, 30 μm, 36 μm, 48 μm and 15 μm, respectively. The physical value and film construction of the heating resistive-element layer 502 were the same as those of the embodiment shown in FIGS. 5A and 5B, and a liquid discharge portion similar to that shown in FIGS. 6A and 6B was formed so that a liquid or ink might be discharged therethrough. In this embodiment, it was possible to control the size of droplets in three steps of 46 μm, 59 μm and 70 μm.

Figure 8A:
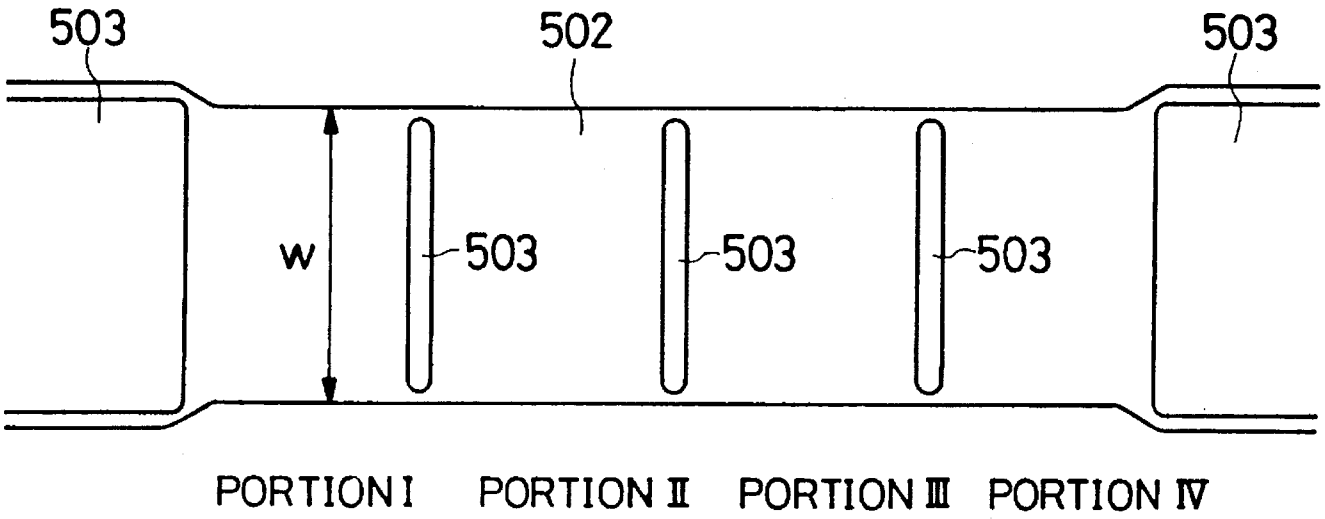
FIG. 8A is a diagrammatic plan view illustrating the essential portion of a third preferred embodiment of the liquid jet recording head of the present invention.
Figure 8B:
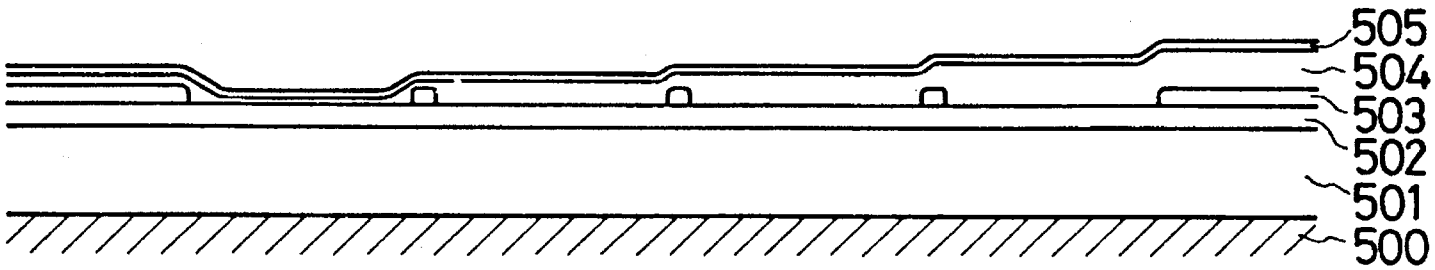
FIG. 8B is a diagrammatic side view in cross section of the example shown in FIG. 8A.

FIGS. 8A and 8B illustrate a third preferred embodiment of the present invention. The heating portion of this embodiment includes series-connected four portions I, II, III and IV of the heating resistive-element layer 502, and each of these portions is made of $HfB_2$ and has the same resistance and width. The protective layer 504 made of, e.g., $SiO_2$ is formed over the heating elements in such a manner that the film thickness of the layer 504 is varied in step-by-step fashion as shown in FIG. 8B. By way of example, the film thicknesses of the portions I to IV were selected to be 0.6 μm, 1.0 μm, 1.5 μm and 2.0 μm, respectively, and w was selected to be 35 μm. In this example, the power density required for bubble generation at each of the portions I to IV was as follows: $2.7\times10^{-3}$ W/μm$^3$ (the portion I); $3.3\times10^{-3}$ W/μm$^3$ (the portion II); $3.9\times10^{-3}$ W/μm$^3$ (the portion III); and $4.6\times10^{-3}$ W/μm$^3$ (the portion IV).

The heating portion illustrated in this embodiment was employed to form a liquid discharge portion similar to that shown in FIGS. 5A and 5B, and, by way of example, ink was discharged through the thus-formed liquid discharge portion. The application of drive voltages of 33 V, 36.5 V, 39 V and 42 V realized control over the diameters of droplets in four steps of 41 μm, 48 μm, 59 μm and 68 μm, and therefore high-quality dots were formed on the surface of a recording medium.

Figure 9:
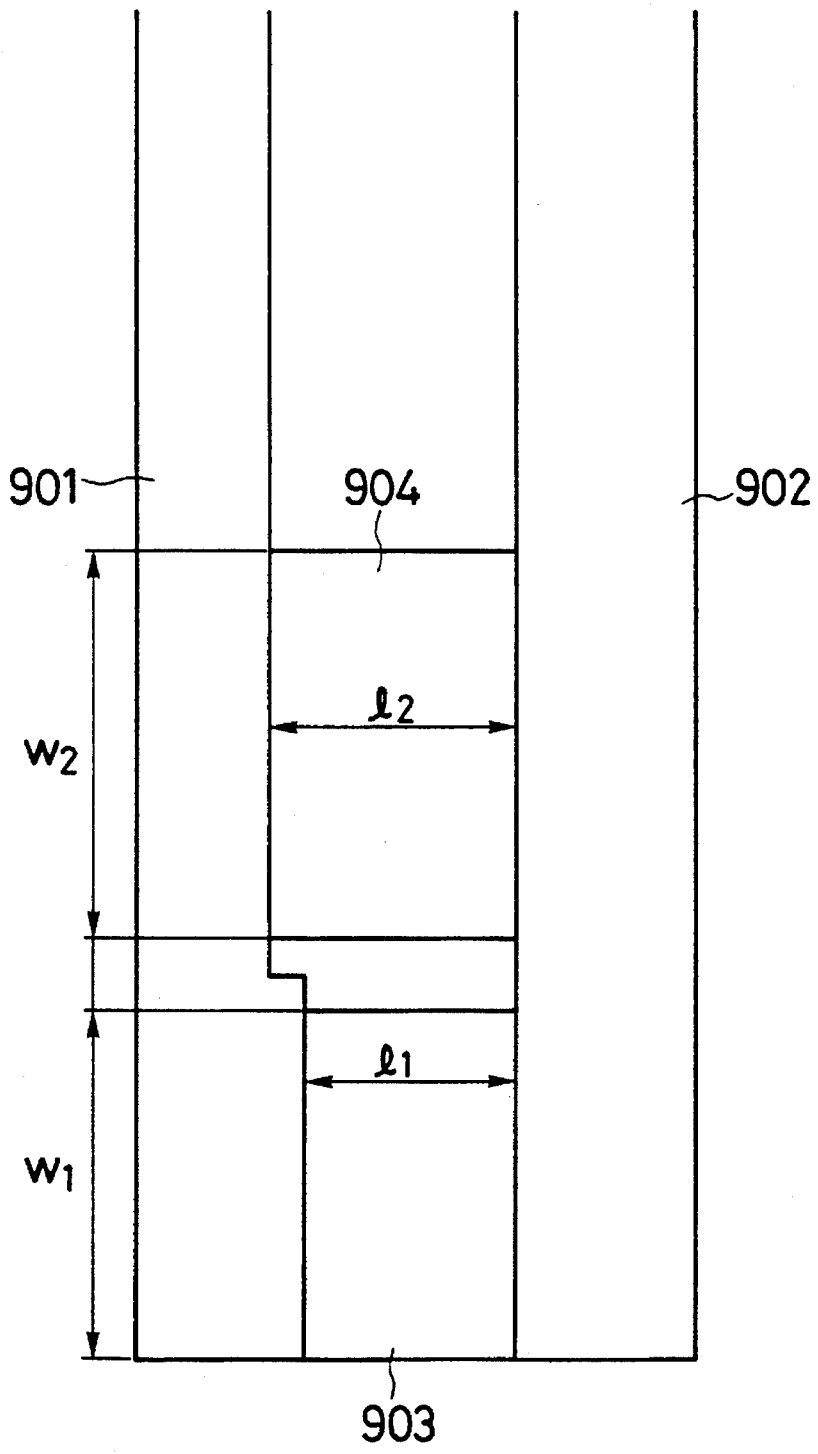
FIG. 9 is a diagrammatic plan view illustrating the essential portion of a fourth preferred embodiment of the liquid jet recording head of the present invention.

Referring to FIG. 9 which illustrates a fourth preferred embodiment of the present invention, two heating elements of $HfB_2$ are connected in parallel. As illustrated, this embodiment includes electrodes 901 and 902, a first heating element 903, a second heating element 904 and a liquid discharge opening (not shown in FIG. 9) formed at a position near the first heating element 903. The first heating element 903 has a width $W_1$ of 50 μm and a length $l_1$ of 30 μm, and the second heating element 904 has a width $w_2$ of 55 μm and a length $l_2$ of 35 μm. The film construction of each of the heating elements taken in the direction of the thickness thereof is the same as that of the embodiment illustrated in FIGS. 5A and 5B.

Drive voltages were calculated in a similar manner to that of the second preferred embodiment, and a recording liquid was discharged in two steps corresponding to 15.5 V and 18.0 V. The resultant diameter of droplets were 40 μm at 15.5 V and 49 μm at 18.0 V, and high-quality dots which exhibited a substantially uniform dot diameter in each step of gradation were formed on a recording surface.

In this embodiment, two heating elements are connected in parallel for the purpose of illustration. However, three or more heating elements may of course be connected in parallel so that recording is enabled in three or more steps of gradation.

It is to be noted that, in the embodiment described previously in connection with FIG. 6, the grooved cover member 507 including the separation walls 514 may be formed of, for example, a light sensitive material such as a light sensitive resin. The grooved cover member 507 may be formed as either a single member or a lamination including a plurality of members.

As illustratively shown in FIG. 6, the aforesaid liquid discharge opening is formed so as to allow ink to be discharged substantially parallel to the direction in which the ink is supplied. However, the present invention is not confined solely to this construction. For example, the liquid discharge opening may also be formed so as to allow ink to be discharged substantially normal to the direction of ink supply.

Figure 10:
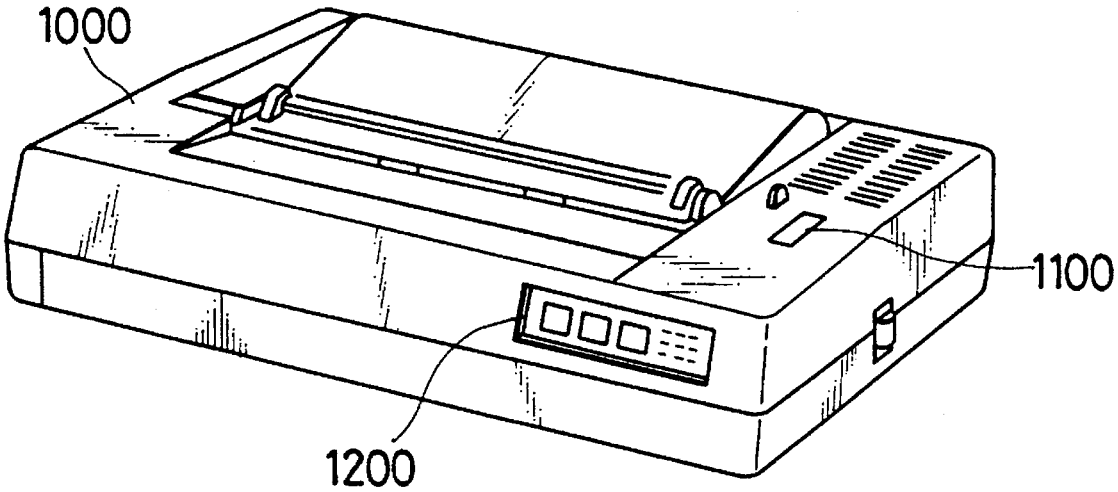
FIG. 10 is a diagrammatic perspective view illustrating one example of an ink jet recording apparatus in accordance with the present invention.

FIG. 10 is a diagrammatic perspective view of one example of the ink jet recording apparatus to which the present invention is applied. In FIG. 10, reference numeral 1000 denotes the body of the apparatus, 1100 a power switch, and 1200 an operation panel.

As described above, in accordance with the present invention, since step-by-step control is provided over gradation, any area in which bubble generation narrowly occurs can be eliminated. It is therefore possible to prevent the generation of minute bubbles which may cause variations in the speed of ink discharge. Accordingly, stable discharge is enabled, and hence recording of uniformly controlled gradation becomes possible. Moreover, in accordance with the present invention, when a plurality of heating elements are connected within a single liquid path, it becomes unnecessary to provide circuit elements such as multilayer wiring or circuits for inputting independent signals to each of the heating elements. This enables high-density but inexpensive integration of the arrangement of the liquid discharge portion.

Moreover, in accordance with the present invention, the spacing between adjacent ones of the heating elements can be suitably determined so as to select the number or size (diameter) of bubbles to be generated. This widens the freedom of design. For example, if the spacing is to some extent enlarged, one bubble can be generated above each of a plurality of heating elements in accordance with the magnitude of power supplied. Alternatively, if the spacing is extremely reduced, one large stable bubble can be generated above a plurality of heating elements in accordance with the magnitude of power supplied.

It is to be noted that the term "heating elements" used herein may of course embrace a structure in which they are integrally combined with each other like the heating resistive-element layer 502 shown in FIGS. 5A and 5B and, additionally, an arrangement in which one heating element is functionally divided by the provision of the electrodes 503 illustrated in FIGS. 8A and 8B.

It will be appreciated from the foregoing that the present invention succeeds in providing a liquid jet recording head and a liquid jet recording apparatus having the same, in which in the liquid jet recording head the high-density arrangement of each liquid discharge portion can be achieved by using remarkably simplified wiring and in which a liquid (or ink) is discharged from each liquid discharge portion at a uniform speed so that gradation control which enables high-density recording can be accomplished.

What is claimed is:

1. A liquid jet recording head in which a plurality of recording elements are integrated, each of said recording elements comprising:

a discharge opening through which a liquid is discharged;

a liquid path communicating with said discharge opening;

a plurality of heat generating elements disposed in said liquid path for heating said liquid to form a gas bubble, said heat generating elements being disposed at intervals, each said heat generating element having a width which is constant, said widths of successive said heat generating elements being mutually different;

at least one connecting member, each said connecting member being disposed between successive said heat generating elements within the intervals so as to connect electrically and in series said successive heat generating elements, each of said connecting members being dimensioned so that a width of each said connecting member varies monotonically from approximately said width of one adjacent said heat generating element to approximately said width of said other adjacent heat generating element, each said connecting member having a lower electrical resistance than that of both said adjacent heat generating elements; and a pair of electrodes for allowing supply of an adjustable drive signal level from a drive source to both ends of said plurality of heat generating elements connected electrically and in series, wherein the gas bubble is formed with a predetermined number of said heat generating elements to control the amount of liquid discharged from the discharge opening by changing the drive signal level supplied to said heat generating elements, so that one liquid droplet of a predetermined discharge amount is discharged from said discharge opening per one supply of the drive signal to said heat generating elements.

2. A liquid jet recording head according to claim 1, wherein said plurality of heat generating elements comprise a resistive layer series-connected to said electrodes and a protective layer overlying said resistive layer.

3. A liquid jet recording head according to claim 1, wherein said plurality of heat generating elements comprise a resistive layer parallel-connected to said electrodes and a protective layer overlying said resistive layer.

4. A liquid jet recording head according to claim 1, wherein said heat generating elements are formed of at least one material selected from the group consisting essentially of tantalum nitride, nickel-chromium, silver-palladium alloy and silicon semiconductors, and metals such as hafnium, lanthanum, zirconium, titanium, tantalum, tungsten, molybdenum, niobium, chromium and vanadium and alloys thereof.

5. A liquid jet recording head according to claim 1, wherein each said electrode is formed of at least one material selected from the group consisting essentially of aluminum, silver, gold, platinum and copper.

6. A liquid jet recording head according to claim 1, wherein said discharge opening is formed to allow said liquid to be discharged substantially parallel to the direction in which said liquid is supplied along said liquid path.

7. A liquid jet recording head according to claim 1, wherein said discharge opening is formed to allow said liquid to be discharged substantially normal to the direction in which said liquid is supplied along said liquid path.

8. A liquid jet recording head according to claim 1, wherein said plurality of heat generating elements comprise a plurality of heat generating portions of a common resistive layer, each said heat generating portion having a different area.

9. A liquid jet recording head according to claim 8, wherein a conductive electrode portion partitions adjacent said heat generating portions.

10. A liquid jet recording head according to claim 8, wherein the width of adjacent said heat generating portions is different.

11. A liquid jet recording head according to claim 1, wherein said plurality of heat generating elements comprise a plurality of heat generating portions having substantially the same thickness and width and a protective layer on said heat generating portions, wherein said protective layer has a different thickness on different said heat generating portions.

12. A liquid jet recording head according to claim 11, wherein said protective layer is formed of a material selected from the group consisting essentially of $SiO_2$ and SiN.

13. A liquid jet recording head according to claim 1, wherein said heat generating elements are arranged in an order of heat generating characteristic.

14. A liquid jet recording apparatus comprising a liquid jet recording head in which a plurality of recording elements are integrated, each of said recording elements comprising:

a discharge through which a liquid is discharged;

a liquid path communicating with said discharge opening;

a plurality of heat generating elements disposed in said liquid path for heating said liquid to form a gas bubble, said heat generating elements being disposed at intervals, each said heat generating element having a width which is constant, said widths of successive said heat generating elements being mutually different;

at least one connecting member, each said connecting member being disposed between successive said heat generating elements within the intervals so as to connect electrically and in series said successive heat generating elements, each of said connecting members being dimensioned so that a width of each said connecting member varies monotonically from approximately said width of one adjacent said heat generating element to approximately said width of said other adjacent heat generating element, each said connecting member having a lower electrical resistance than that of both said adjacent heat generating elements; and a pair of electrodes for allowing supply of an adjustable drive signal level from a drive source to both ends of said plurality of heat generating elements connected electrically and in series, wherein the gas bubble is formed with a predetermined number of said heat generating elements to control the amount of liquid discharged from the discharge opening by changing the drive signal level supplied to said heat generating elements, so that one liquid droplet of a predetermined discharge amount is discharged from said discharge opening per one supply of the drive signal to said heat generating elements.

* * * * *

UNITED STATES PATENT AND TRADEMARK OFFICE

CERTIFICATE OF CORRECTION

PATENT NO. : 5,481,287

DATED : January 2, 1996

INVENTOR(S) : MASAYOSHI TACHIHARA

It is certified that error appears in the above-identified patent and that said Letters Patent is hereby corrected as shown below:

COLUMN 2

Line 45, "is" should read --as--.

COLUMN 3

Line 10, "record" should read --recording--.

COLUMN 5

Line 22, "aluminium," should read --aluminum,--.
Line 35, Aluminum" should read --aluminum--.

COLUMN 10

Line 4, "discharge" should read --discharge opening--.

Signed and Sealed this

Fourth Day of June, 1996

Bruce Lehman

*Attest:*

BRUCE LEHMAN

*Attesting Officer*

*Commissioner of Patents and Trademarks*